United States Patent [19]

Inloes et al.

[11] 4,227,437

[45] Oct. 14, 1980

[54] FREQUENCY DETECTING APPARATUS

[76] Inventors: Thomas L. Inloes, 032 SW. Seymour; Darwin E. George, 031 SW. Slavin, both of Portland, Oreg. 97201

[21] Appl. No.: 841,004

[22] Filed: Oct. 11, 1977

[51] Int. Cl.[2] ..... G10G 7/02

[52] U.S. Cl. ..... 84/454; 321/79 D

[58] Field of Search ..... 84/454, 1.01, 1.11, 84/1.19, 1.23, 464; 324/79 D, 79 R, 78 R

[56] References Cited

U.S. PATENT DOCUMENTS

| | | | |
|---|---|---|---|
| 3,144,802 | 8/1964 | Faber | 84/454 |
| 3,766,818 | 10/1973 | Prohofsky | 84/454 |
| 4,014,242 | 3/1977 | Sanderson | 84/454 |
| 4,120,229 | 10/1978 | Ota | 324/79 R |

FOREIGN PATENT DOCUMENTS

| | | | |
|---|---|---|---|
| 1213794 | 12/1966 | United Kingdom | 84/454 |

*Primary Examiner*—L. T. Hix
*Assistant Examiner*—S. D. Schreyer
*Attorney, Agent, or Firm*—Klarquist, Sparkman, Campbell, Leigh, Hall & Whinston

[57] ABSTRACT

A detecting apparatus for tuning musical instruments receives an input signal from a sound transducer and removes second harmonic content therefrom by means of a filter responsive to a note and octave selection. A phase lock pulse generator receives the filtered output and generates a signal in step with the input sound signal. The generated signal is counted by a note counter during a gating period derived by counting a predetermined number of output cycles of an oscillator started in step with the input signal. Three outputs indicating "on-frequency", "sharp" or "flat" are supplied in the alternative at the end of the gating period in accordance with the count in the note counter at that time.

18 Claims, 3 Drawing Figures

FREQUENCY DETECTING APPARATUS

BACKGROUND OF THE INVENTION

The present invention relates to tuning apparatus for musical instruments, and particularly to such apparatus capable of producing accurate tuning results with a minimum of equipment bulk and expense.

Numbers of devices have been proposed for tuning musical instruments such as guitars, so such an instrument can be accurately tuned by other than a skilled musician or without requiring a lengthy comparison. Much of the equipment proposed has, however, required a certain amount of musical and/or electronic skill in its operation, or it has been relatively inaccurate in tuning results. Oscilloscope circuitry on the one hand, is capable of comparing a given sound input with a frequency standard, but the bulky equipment and expense involved makes it unsuitable for ready, portable use. On the other hand, some small tuning devices are capable of tuning an instrument within certain tolerances, but real accuracy of tuning remains in question.

SUMMARY OF THE INVENTION

In accordance with the present invention, a tuning apparatus provides three visual output indications, i.e., on-frequency, sharp and flat, in response to a comparison between an input sound and a frequency selected by the apparatus. An input sound transducer converts a sound signal to an electrical signal which is filtered to remove sound harmonic content in accordance with the note selected. A phase lock oscillator receives the filtered output and produces pulses counted by a note counter during a predetermined gating period. The gating period is in turn determined through counting the cycles of a second, standard oscillator, the operation of which is initiated by the filtered output corresponding to the input signal. If the note counter has counted a quantity indicating the selected frequency at the end of the gating period, the display corresponding to on-frequency is operated. If the note counter counts the same number before the end of the gating period, the sharp output display is initiated, while if neither occurs, the flat indication is given. The output indication is accurate within one count and gives a definite indication of the tune or out-of-tune for the tested instrument. The apparatus selection means can select any of the standard frequencies associated with a guitar or the like.

It is accordingly an object of the present invention to provide an improved frequency detector for tuning musical instruments.

It is another object of the present invention to provide an improved frequency detector for tuning musical instruments with greater accuracy.

It is a further object of the present invention to provide an improved frequency detecting apparatus which is economical in construction, small in size and adapted for portable use.

It is another object of the present invention to provide an improved frequency detector for tuning musical instruments, wherein such detector employs primarily digital circuitry capable of considerable miniaturization and portability.

The subject matter which we regard as our invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a block diagram of a frequency detecting apparatus according to the present invention, FIG. 2 is a schematic diagram of a first portion of said apparatus, and FIG. 3 is a schematic diagram of a second portion of such apparatus.

DETAILED DESCRIPTION

Figure 1:
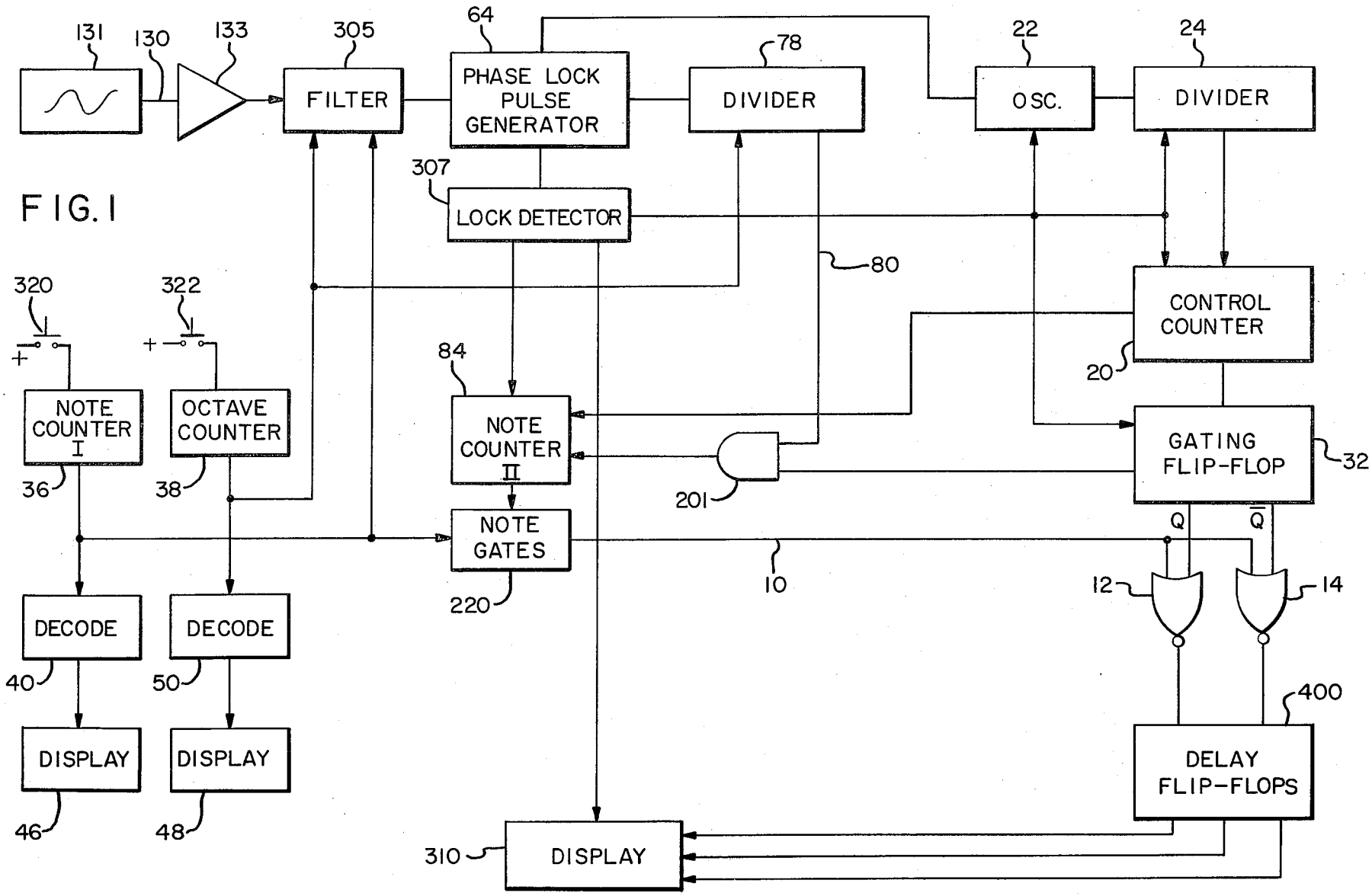

Referring to FIG. 1, illustrating a generalized block diagram of the apparatus according to the present invention, a sound transducer 131, which may take the form of a pickup, microphone or the like, produces an output signal on lead 130 corresponding to the sound input received. The transducer may be placed upon a guitar, and a string plucked for supplying a corresponding waveform via lead 130 to amplifier 133. The amplified output produced by amplifier 133 is coupled to a filter 305 adapted for filtering the harmonic content and especially second harmonic content of the input signal, as hereinafter more fully described, for avoiding confusion in tuning the correct note. The filter 305 is operated in accordance with the note and octave selected for tuning. A note counter(I) 36 and an octave counter 38 are operated by pushbutton switches 320 and 322 respectively, wherein momentary operation of one of the switches advances the corresponding counter by one digit. The note counter(I) counts through six notes and then resets itself, while the octave counter counts through three octaves and then resets. The corresponding digital outputs are supplied to filter 305 whereby the latter will produce the correct filtering for a given note input. It is understood the string on the guitar or other stringed instrument plucked will correspond to the note selected by counters 36 and 38. Decoding circuits 40 and 50 respectively couple the outputs of counters 36 and 38 to 7-segment numerical displays 46 and 48 by means of which the operator observes the note and octave selected.

The output of filter 305 is provided to a phase lock pulse generator or oscillator 64 for producing a pulse output corresponding in frequency to the frequency of the input sound signal. The output of pulse generator 64 is supplied to a note counter(II) 84 via a divider 78, lead 80 and AND gate 201 such that the note counter(II) counts the cycles of the input signal during a predetermined gating period which is set by gating flip-flop 32. The divider 78 is responsive to octave counter 38 whereby the same note count is made effective for three octaves. That is, the count for the note A, for example, will be the same regardless of the octave selected, with the divider 78 acting to divide down the input signal for the higher octaves.

A second oscillator 22 is responsive in its operation to that of phase lock pulse generator 64, or the output of filter 305, so that oscillation by oscillator 22 is initiated at the same time an input signal is received. This synchronized start of operation prevents erratic output behavior which could depend upon the relative phase relationship that might otherwise occur between oscillators 22 and 64. Oscillator 22 is a standard frequency oscillator, and in this case produces a frequency output of 400 Hertz divided by divider 24 to supply a standard 40 Hertz signal to control counter 20. Control counter 20 operates gating flip-flop 32 so that the latter enables AND gate 201 for a predetermined gating period comprising five cycles of the output of divider 24. Since the output of divider 24 is a 40 Hertz signal, then gate 201 will be energized for one-eighth of a second. During this time, the pulses from pulse generator 64 via divider 78 are supplied to note counter(II) 84. The output of note counter 84 is a digital value coupled to note gates 220 which are arranged to detect particular numerical outputs and supply a pulse on line 10 when a count corresponding to a particular note occurs. The note being detected, and therefore the individual note gate selectively employed, is determined by the output of note counter(I) 36.

During the time flip-flop 32 provides a gating interval to AND gate 201, the Q output of the flip-flop is supplied to NOR gate 12. At other times, the Q output will be down and the $\overline{Q}$ will be up, as coupled to NOR gate 14. Lead 10 supplies the second input to gates 12 and 14, comprising a negative going pulse, when a particular note count is detected by note gates 220. If this negative going pulse occurs on line 10 before the end of the gating period, both inputs to NOR gate 14 will be down and the gate 14 output will be up for supplying a "sharp" indication to delay flip-flops 400. If, on the other hand, the negative going pulse occurs on line 10 at the end of the gating interval, just as the Q output lowers, then NOR gate 12 provides a positive going output indicating an "on-frequency" condition. It will be observed that note counter 84 does not count beyond the gating period but is reset, so line 10 will not provide a negative going pulse at some later time. If, however, neither gate 12 nor gate 14 is operated, this will be interpreted by delay flip-flops 400 as indicating a "flat" condition. Three separate indications are given by display 310, i.e., a sharp, flat or on-frequency output. The on-frequency indication is accurate within one pulse time. To prevent rapid fluctuation in the output indication, the delay flip-flops 400 comprise an array of double flip-flops wherein a given flat, sharp or on-frequency condition must be maintained for two count cycles before the display is changed. This counteracts momentary changes or unnecessary jumps in display 310. Furthermore, a lock detector 307 is incorporated which detects when phase lock pulse generator 64 is locked to the output of filter 305. In the event such locking is absent, then note counter 84, oscillator 22, divider 24, control counter 20, flip-flop 32 and display 310 are disabled until locking is restored.

Figure 2:
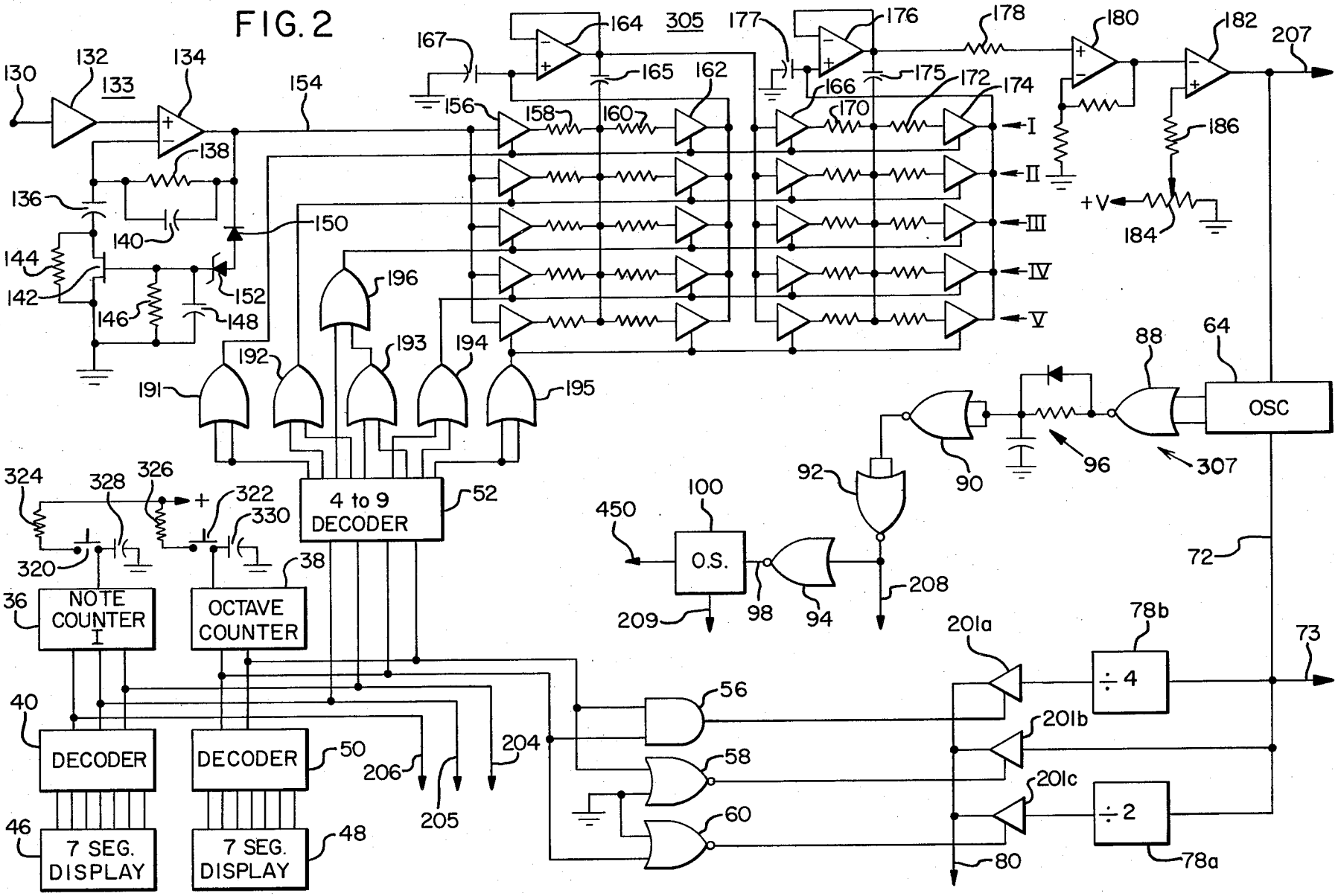
Figure 3:
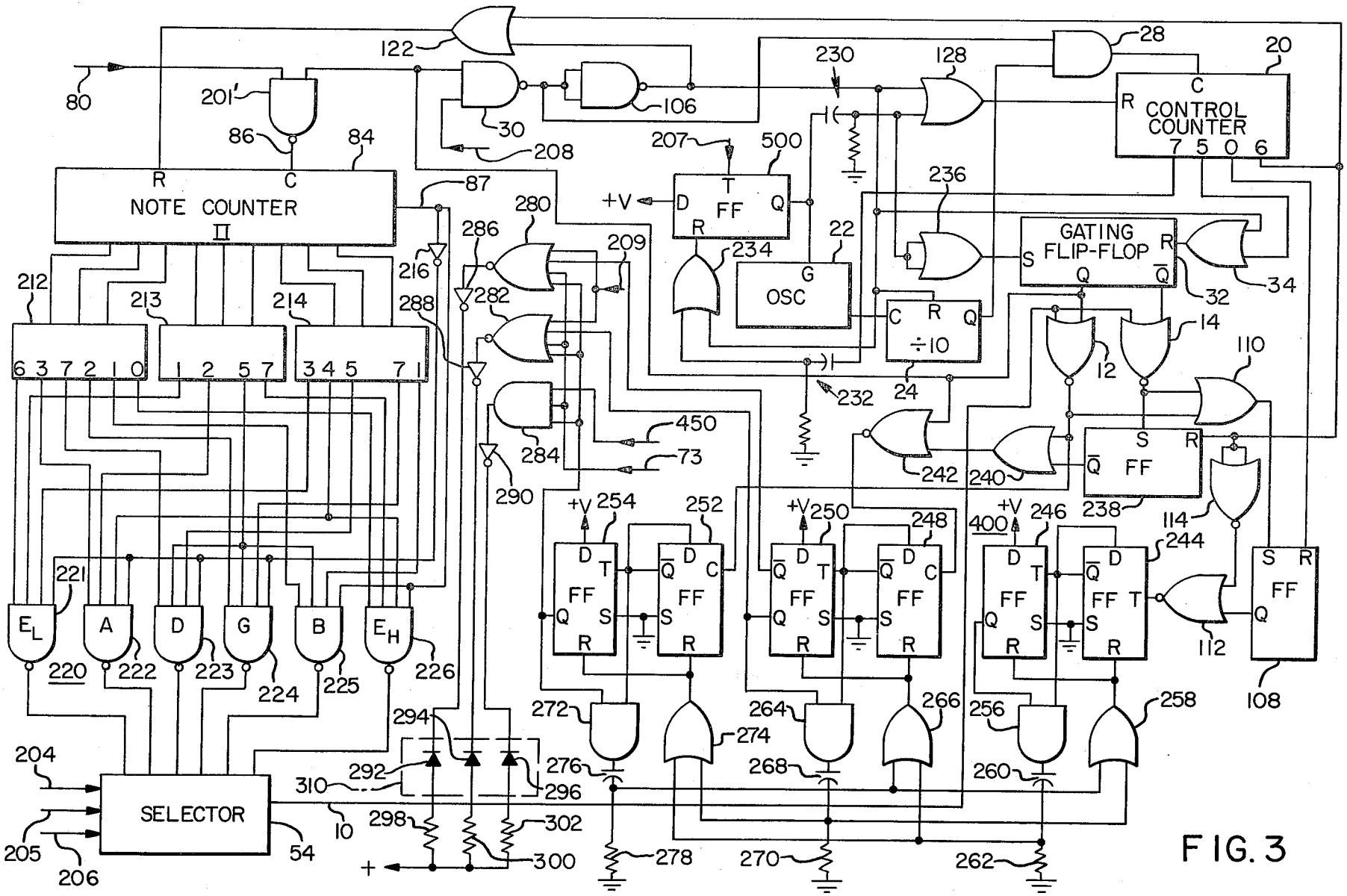

Referring now to the circuit in greater detail, reference is made to FIGS. 2 and 3 wherein like reference numerals refer to like elements. The input signal on line 130 from the transducer is coupled to amplifier 133 which comprises a first input amplifier 132 driving a second amplifier 134. Input amplifier 132 is preferrably designed to have high common mode rejection.

The output of amplifier 132 is coupled to the non-inverting input of amplifier 134, the latter including a feedback circuit comprising a parallel combination of resistor 138 and capacitor 140 connected between the amplifier output and the inverting input. A series circuit comprising capacitor 136 and resistor 144 returns the inverting input to ground, wherein the resistor 144 is shunted by the drain-source path of field effect transistor 142. The gate of field effect transistor 142 is returned to ground by the parallel combination of resistor 146 and capacitor 148, and the gate is also connected to the output of amplifier 134 through Zener diode 152 in series with diode 150 poled as shown so that a negative going amplifier output exceeding the breakdown voltage of the Zener diode will place a negative filtered voltage at the gate of field effect transistor 142 across capacitor 148.

Amplifier 134 is designed to deliver a stable 7 to 8 volt output over an input range of approximately 60 DB. The gain of amplifier 134 is determined by the relationship of the feedback resistor 138 and the parallel combination of resistor 144 with the drain-to-source resistance of field effect transistor 142. If no input signal is present, the gate-to-source voltage of the field effect transistor is zero, and the amplifier is set to maximum gain. When the input signal increases, to an amplitude such that the average output value, as rectified by diode 150, exceeds the breakdown voltage of Zener diode 152, a more negative voltage is developed across the parallel combination of resistor 146 and capacitor 148. This negative gate-to-source voltage decreases the drain-to-source current, therefore increasing the drain-to-source resistance and decreasing the gain of the amplifier until the output voltage thereof has reached a point whereby Zener diode 152 turns off. The circuit is thus self regulating to provide a fairly constant amplitude output on lead 154, for example as a string of a stringed instrument is plucked.

The signal at lead 154, although amplitude stabilized, contains, in addition to a fundamental frequency of the string played, noise and components harmonically related to the fundamental. The filter 305 is designed to remove the second harmonic, and frequencies above the second harmonic as well, for preventing error in operation of the circuitry. Filter 305 comprises a programmable active filter and consists of a common form four pole Chebyshev low pass active filter, which is programmable to yield any one of five possible cutoff frequencies: 50 Hz, 100 Hz, 190 Hz, 400 Hz and 760 Hz. This type of filter is discussed and design calculations disclosed as part of the Honeywell Applications Systems Library. The program is entitled LFILTR—June 1972, its associated data program is entitled LFLDAT, and instruction program LFLTIN, by Honeywell, Inc. However, values suitable for components in the present embodiment are given below.

The basic filter includes operational amplifiers 164 and 176 disposed in a unity gain or closed loop voltage follower configuration, and having their non-inverting inputs returned to ground via capacitors 167 and 177 respectively.

The characteristics of filter 305 are controlled by five groups of four resistors each, where the groups are designated I, II, III, IV and V. Filter resistor group I will be described, it being understood the remaining groups are substantially identical. The output lead 154 of amplifier 134 is coupled through analog gate 156 to a series combination of resistors 158 and 160 leading to a second analog gate 162. The output of analog gate 162 is connected to the non-inverting input of amplifier 164, while the output of amplifier 164 is connected to a third analog gate 166. Gate 166 drives resistors 170 and 172 in series, the latter being connected to a fourth analog gate 174, and the output of gate 174 is coupled to the non-inverting input of amplifier 176 from which the output of the filter is delivered. A capacitor 165 couples the output of amplifier 164 to the interconnection between resistors 158 and 160. Similarly, a capacitor 175 is disposed between the output of amplifier 176 and the junction of resistors 170 and 172.

Filter groups I, II, III, IV and V are selectively energized by means of OR gates 191, 192, 196, 194 and 195, each of which energize all the analog gates of one resistor group to provide the differing frequency characteristics. Whenever the output of gate 191 is energized, filter group I is activated, having a cutoff frequency of 50 Hz. Whenever the output of gate 192 is energized, filter group II is activated, having a cutoff frequency of 100 Hz. Gates 196, 194 and 195 energizing filter group III, IV and V respectively, produce cutoff frequencies of 190 Hz., 400 Hz. and 760 Hz.

In a particular embodiment, each of the resistors 158, 160, 170 and 172 for the filter group I had a resistance of 2.5 megohms. The resistors of filter group II each had a resistance of 1.4 megohms, while the value for the resistors of group III was 720 K ohms, the value for those of filter group IV was 420 K ohms, and the value for those of group V was 200 K ohms. Capacitor 167 had a value of 120 picofarads, capacitor 165 had a value of 0.01 microfarads, capacitor 177 had a value of 0.0012 microfarads and capacitor 175 had a value of 0.0041 microfarads.

The second harmonic attenuation secured, and the filter employed therefor, are given in Table A. The system of the present embodiment is designed to tune the six notes of a conventional guitar; $E_L$ (82.4 Hz), A (110 Hz), D (146.8 Hz), G (196 Hz), B (246.8 Hz) and $E_H$ (329.6 Hz). This corresponds to octave two in Table A. The apparatus according to the present invention is adapted to tune one octave below this to accomodate the bass guitar and one octave above for the 12 string, banjo or various instruments. The attenuation at the second harmonic in each case is given under the heading "ATT", and the filter group employed therefor is indicated under the heading "FLT".

gates are supplied by a 4 (binary) to 9 line decoder 52, operating in response to the note counter(I) 36 and octave counter 38, which are in turn controlled by means of pushbuttons 320 and 322. A first terminal of pushbutton 320 is connected to a positive voltage via resistor 324, and its remaining terminal, shunted to ground by capacitor 328, is coupled to operate note counter(I). Each time the pushbutton is depressed, note counter(I) 36 changes count, through a total of 6 counts, representing the 6 notes $E_L$ through $E_H$ mentioned above, before resetting. A decoder 40 converts the binary output of note counter(I) to an input suitable for operating a 7-segment visible display 46 of conventional type so that the operator may view the representation of the note which counter 36 is currently selecting.

Similarly, one terminal of pushbutton 322 is connected to a positive voltage via resistor 326 while its remaining terminal is connected as an input to octave counter 38 while being shunted to ground through capacitor 330. Octave counter 38 counts to three and then resets in accordance with the three octave selection described above. Decoder 50 converts the binary output of octave counter 38 to a suitable input to 7-segment display 48 by means of which the operator can ascertain the octave to which counter 38 is currently set.

The binary outputs from octave counter 38, as well as the two higher order binary outputs from note counter(I) 36 are connected as inputs to the 4 to 9 line decoder 52 which operates in a conventional matrix fashion to energize either gate 191, 192, 196, 194 or 195. The coding is performed to select the respective filters I through V in the manner indicated in Table A. Thus, a single line output of decoder 52 is energized for each of nine possible combinations of inputs which may be supplied thereto. It will be observed from Table A that only one input combination energizes filter group I and this is accomplished with gate 191. The input for gate

TABLE A

| | OCTAVE ONE | | | OCTAVE TWO | | | OCTAVE THREE | | | |
|---|---|---|---|---|---|---|---|---|---|---|
| NOTE | FREQ. | FLT. | ATT. | FREQ. | FLT. | ATT. | FREQ. | FLT. | ATT. | COUNT |
| $E_L$ | 41.2 | I | −27 | 82.4 | II | −27 | 164.8 | III | −30 | 206 |
| A | 55.0 | I | −38 | 110.0 | II | −38 | 220.0 | III | −40 | 275 |
| D | 73.4 | II | −22 | 146.8 | III | −22 | 293.6 | IV | −18 | 367 |
| G | 98.0 | II | −32 | 196.0 | III | −35 | 392.0 | IV | −32 | 490 |
| B | 123.4 | III | −14 | 246.8 | IV | −14 | 493.6 | V | −14 | 617 |
| $E_H$ | 164.8 | III | −30 | 329.6 | IV | −24 | 659.2 | V | −30 | 824 |

It can be seen from the data in Table A that the second harmonic content of any selected input is attenuated by 14 to 40 DB. It may also be noted that the A note in all three octaves is beyond the cutoff frequency of its associated filter. This situation results in some attenuation of the fundamental frequency, but to alleviate this condition, all output signals from the filters are amplified in amplifier 180 coupled to the output of amplifier 176 via coupling resistor 178. The circuit yields a stable, standard amplitude representation of the fundamental frequency of any selected input. The signal is now converted into a square wave by means of a squaring amplifier 182 having its inverting input coupled to the output of amplifier 180 and its non-inverting input connected to the movable arm of a potentiometer 184 via resistor 186. This amplifier is set to saturate for each waveform cycle. Alternatively, a Schmitt trigger or multivibrator can be employed.

The selection of the filter group, I, II, III, IV, or V, is accomplished through selective energization of gates 191–196, as hereinbefore described. The inputs to these

191 is activated when the octave counter delivers its lowest digital output and the note counter(I) delivers its lowest digital output. Similarly, gate 195 is energized when both counters have their highest digital outputs. Gates 192 and 194 are operated for each of two input combinations, while gate 196 is energized for three input combinations. Thus it can be seen that the filter III grouping occurs three times on Table A.

The output of squaring or pulse shaping amplifier 182 is provided as a synchronization input to phase lock pulse generator or oscillator 64. This phase lock pulse generator is of a known type and may comprise an RCA type CD 4046A micro power phase lock loop. In the present instance, the oscillator 64 is arranged to produce an output frequency which is multiple of its input frequency by employment of dividers within the phase lock loop circuit itself in a conventional manner. The multiplication is 40, so the output on line 72 is a pulse waveform having a frequency 40 times that on lead 207. Phase lock loop oscillator 64 is also provided with a lock detector 307, which indicates when the oscillator 64 is indeed locked to its input synchronization to provide a correct representation thereof. This lock detector is of the type disclosed in "RCA COS-MOS Integrated Circuits" published by the Radio Corporation of America, 1975, pages 471–478, and particularly page 478. The outputs from a pair of comparators in the phase lock loop oscillator 64 are provided as inputs to NOR gate 88 driving an integrating circuit 96, the output of which is connected in driving relation to NOR gate 90. NOR gate 90 in turn drives NOR gate 92, the output of which is labeled 208. Lead 208 is connected to a further NOR gate 94 providing its output at 98 as an input to one-shot multivibrator 100 which supplies oppositely poled outputs on leads 209 and 450. Under ordinary circumstances, when the oscillator 64 is correctly locked to the input signal, the output of gate 88 will be down. However, should the oscillator 64 lose sync, the integrating circuit 96 charges up in a positive direction, delivering a relatively positive going output at 208 and a relatively negative going output at 98. The relatively negative going output at 98 triggers one-shot multivibrator 100 which produces a positive going output on lead 209 for a predetermined length of time when oscillator 64 goes out of lock, and a negative going output on lead 450 for a predetermined length of time when oscillator 64 goes out of lock. These signals are employed as hereinafter more fully described with reference to FIG. 3.

The output of phase lock oscillator 64 on line 72 in FIG. 2 is coupled to an output lead 80 via analog gate 201*b*. The output of phase lock oscillator 64 on line 72 is also coupled to output lead 80 by way of analog gate 201*c* but with a divide-by-two circuit 78*a* interposed between line 72 and the analog gate. Similarly, line 72 is coupled to output lead 80 by analog gate 201*a*, with divide-by-four circuit 78*b* interposed between line 72 and the gate. The division circuits 78*a* and 78*b* respectively divide the output of oscillator 64 by two and four whereby the signal on lead 80 may be selectively controlled to be 20 or 10 times the frequency of the output of filter 305 rather than 40 times the same.

Analog gates 201*a*, 201*b* and 201*c* are respectively operated by AND gate 56, NOR gate 58 and NOR gate 60. Gates 56, 58 and 60 are responsive to the binary outputs of octave counter 38 such that the output of gate 58 is high for the lowest octave count from the octave counter (binary 01) for operating gate 201*b*, the output of gate 60 is high for the second octave count of octave counter 38 (binary 10) for operating gate 201*c*, and the output of gate 56 is high for the high octave count of octave counter 38 (binary 11) for operating gate 201*a*. It will be seen that the frequency of the output on line 80 for a particular correctly pitched note will be the same for any of the three octaves. Thus, for the lowest octave selection, the output of oscillator 64 is not divided, but for the second and third octave selections, the output of oscillator 64 is appropriately divided down whereby the comparison with only six notes may be made rather than a comparison with 18 notes.

Referring now to FIG. 3, the output numbered 80 is coupled to the clocking input of note counter(II) via NAND gate 201' which receives a second input from gating flip-flop 32. Thus, as hereinbefore described, the stream of pulses on line 80 from oscillator 64 is delivered to note counter (II) during the gating period of gating flip-flop 32. NAND gate 201' corresponds to gate 201 in FIG. 1, and provides a negative going clock on line 86 for note counter(II) 84. Note counter 84 is a 10-digit binary counter. The most significant bit of output of note counter 84 is delivered on lead 87, the next three most significant bits are delivered to decoder 214, the next three lower bits are delivered to decoder 213, and the three least significant bits of the count from counter 84 are coupled to decoder 212. Each of the decoders 212, 213 and 214 is a binary to decimal or single line converter such that for a specified binary input, a single line output is produced. Each of the numbers adjacent output leads for decoders 212–214 indicate the single output produced for the binary input corresponding to that number.

Let us assume, for the moment, that the apparatus according to the present invention is to detect the note $E_L$. From the last column on the right in Table A we observe the count for note counter(II) 84 corresponding to this note will be 206, which expressed in binary fashion is 011001110. As mentioned hereinbefore, the counter 84 counts for a gating period which is one-eighth of a second. If the note frequency is 41.2 Hz, multiplied by 40 via phase lock oscillator 64, then the number of cycles counted by counter 84 during its one-eighth of a second gating period will be 206. Let us divide the binary representation for 206 into three, three-digit numbers for examination in the manner performed by decoders 212–214. Since the binary 206 equals 011001110, its lowest three bits provided to decoder 212 are 110 or a binary 6. It is seen the output of decoder 212 labeled 6 is connected to the $E_L$ note gate comprising NAND gate 221. The next three digits of the binary 206 are 001, or a binary 1. It is noted the 1 output of decoder 213 applies a second input to $E_L$ NAND gate 221. Similarly, the highest three digits supplied to decoder 214 are 011, or a binary 3. It is seen the 3 output of decoder 214 applies the third input to NAND gate 221. The fourth input to NAND gate 221, representing the tenth bit of the binary number, is supplied from lead 87 via inverter 216. Since the tenth bit is a 0, it is seen the inverter 216 supplies the correct fourth input to NAND gate 221 for operating the same to supply a negative going output. Similarly, for the other five notes, A through $E_H$ recognized by gates 222–226, the correct decoded count from the right-hand side of Table A will be recognized.

The outputs of gates 221–226 are connected to a switching means or selector 54 receiving inputs 204, 205, and 206 from note counter(I) 36 in FIG. 2. The binary representation of the notes selected on leads 204–206 couples only the correctly selected output of one of the gates 221–226 to output line 10 driving NOR gates 12 and 14. It will be seen the note gates 221–226 together with selector 54 operate as a comparison means or detector for detecting whether the count in note counter(II) 84 is the same as the note selected by note counter(I) 36. If the correct count occurs at the end of the gating period of gating flip-flop 32, an on-frequency indication will be given, and otherwise a sharp or flat indication will be given as hereinafter described.

Oscillator 22 comprises a standard oscillator which is gated into operation by an input on its terminal G received from the Q output of triggering the flip-flop 500. Flip-flop 500 receives this triggering input on line 207 from FIG. 2, which also comprises the input to oscillator 64. Thus, when a waveform is received from filter 305, flip-flop 500 is triggered and starts oscillator 22 in synchronism therewith to avoid the possibility of generating a gating period which bisects part of the pulses being counted. The gating period is established in a stable manner to count the waveform from filter 305 correctly without jitter. Oscillator 22 produces a 400 cycle output which is divided by ten in divider counter 24, the Q output of which is supplied as one input to AND gate 28 for driving the clocking input of control counter 20. The remaining input of AND gate 28 is derived from the lock detector function as hereinafter more fully described. Control counter 20 counts from 0 to 7 and is then reset. When triggering flip-flop 500 is operated for starting oscillator 22, a Q output pulse, differentiated by circuit 230, is coupled to OR gate 128 for driving the reset input of the control counter 20. The counter will now count the divided-down or 40 Hz input from gate 28. The same differentiated Q output of flip-flop 500 that resets counter 20 also sets gating flip-flop 32 via OR gate 236, whereby flip-flop 32 produces a Q output for for enabling gate 201' such that note counter 84 may count. Then, when control counter 20 reaches the count 5, gating flip-flop 32 is reset via OR gate 34. The intervening five cycles of the 40 Hz signal from divider 24 determine a gating period of one-eighth of a second during which counter 84 receives an input. When the control counter reaches count 6, note counter(II) 84 is reset through OR gate 122. Count 7 of counter 20 resets flip-flop 500 through differentiating circuit 232 and OR gate 234. Oscillator 22 is shut off when flip-flop 500 is reset. Thereafter, flip-flop 500 will be retriggered to start another gating and counting cycle, assuming an input signal is still present.

As hereinbefore explained, a negative going pulse on line 10 at the end of the counting period, when the Q output of flip-flop 32 goes low, will produce a positive going output from NOR gate 12. If, on the other hand, note counter(II) 84 reached its prescribed count earlier in the operating cycle, indicating the input note was sharp, NOR gate 14, receiving the $\overline{Q}$ output of flip-flop 32, produces a positive going output. The counting of note counter 84 is concluded via gate 201', so gate 12 will not produce an output if the count was low indicating a flat note. Rather, such a condition will be indicated by non-operation of either gate 12 or gate 14.

The outputs of gate 12 and 14 are coupled through OR gate 110 to the setting input of flip-flop 108 which is reset at each zero count from counter 20 (when counter 20 is reset). Assuming the input note is not flat, then flip-flop 108 will be set from gate 110 during the gating period, since either the output from gate 12 or gate 14 will be up. However, if it is flat, the Q output of flip-flop 108 will remain low and provide one input to NOR gate 112. A second input to NOR gate 112 is derived from the 6 count output of counter 20 via NOR gate 114. If the Q output of flip-flop 108 is low at the end of the gating period, gate 112 will then produce a positive going output for triggering flip-flop 244 forming part of the delay flip-flops 400. Flip-flop 244 is connected as a toggling flip-flop, having its $\overline{Q}$ output connected to its D input, such that a first triggering input thereto will change the state of the flip-flop in a first direction, while a second triggering input thereto will change the state of the flip-flop back in a second direction. Thus, a first input from gate 112 causes the $\overline{Q}$ output of flip-flop 244 to go low, and a second input from gate 112 causes the $\overline{Q}$ output to go high for triggering flip-flop 246. Flip-flop 246 then provides a Q output which is indicative of a flat note condition. The double flip-flop arrangement is desirable since two cycles or two successive gating periods are required before flip-flop 246 is set. This delaying feature avoids momentary incorrect output or jitter in an output indication. Double flip-flops are similarly used for indicating an on-frequency or or sharp condition.

As hereinbefore stated, a high output from NOR gate 12 is indicative of an on-frequency condition. This output is connected to the clocking or trigger input of flip-flop 252 which toggles after two cycles to trigger flip-flop 254. The Q output of flip-flop 254 is connected to AND gate 284 for supplying an on-frequency output. The output of AND gate 284 is connected via inverter 290 to the cathode of a light emitting diode 296 in display 310 having its remaining terminal returned to a positive voltage by means of resistor 302. Thus, diode 296 will be illuminated if the input signal is on-frequency. The remaining inputs to AND gate 284, numbered 73 and 450, connect to the output of oscillator 64, and to the locking circuit as hereinafter more fully indicated. The oscillator output on lead 73 lowers the duty cycle of operation of the light emitting diodes.

In the case of a note which is sharp, or higher in frequency than desired, the output of gate 14 sets flip-flop 238 which is reset at the end of the gating period by count 6 from control counter 20. While flip-flop 238 is set, the $\overline{Q}$ output thereof is low, and if gate 12 does not indicate an on-frequency condition, then both inputs to OR gate 240 will be low as well as its output. At the end of the gating period the Q output of flip-flop 32 will go low, and this, together with the low output from gate 240, will produce a high output from NOR gate 242 for clocking flip-flop 248. Assuming a sharp condition for two successive cycles or gating periods, flip-flop 248 will trigger flip-flop 250, causing the Q output of flip-flop 250 to go high and the $\overline{Q}$ output of flip-flop 250 to go low. The $\overline{Q}$ output is coupled as an input to NOR gate 280 in conjunction with a lock indication on lead 209, an oscillator output on lead 73, and the Q output of flip-flop 254. If all the inputs to gate 280 are low, including $\overline{Q}$ from flip-flop 250, then the output of gate 280 will go high. This output is coupled through inverter 286 to light emitting diode 292 in display 310 having its remaining or anode electrode returned to a positive voltage through resistor 298. Thus, for a sharp condition, light emitting diode 292 will be illuminated.

The Q output of flip-flop 250 is connected to NOR gate 282 in conjunction with a locking indication on lead 209, an oscillator output on lead 73, and the Q output from flip-flop 254. Thus, if the Q output of flip-flop 250 remains low, and if the Q output of gate 254 remains low, then the output of gate 282 will go high for indicating a flat condition. Gate 282 drives light emitting diode 294 in display 310 through inverter 288, with the anode of diode 294 being returned to a positive voltage through resistor 300. Thus, light emitting diode 294 will be illuminated in the instance of a flat condition.

Operation of flip-flop pairs 244–256, 248–250 and 252–254 is exclusive. Thus, operation of one flip-flop pair will act to reset the remaining flip-flop pairs. The Q output of flip-flop 246 together with the $\overline{Q}$ output of flip-flop 244 are coupled as inputs to an AND gate 256 driving a differentiating circuit comprising capacitor 260 and resistor 262. The junction between the last two mentioned components is coupled as an input to OR gates 266 and 274 driving reset terminals of flip-flops 248, 250, 252 and 254. Thus, if flip-flop 244 has toggled such that its $\overline{Q}$ output is up, and the same has triggered flip-flop 246, then the output of gate 256 resets the other two flip-flop pairs. Similarly, the $\overline{Q}$ output of flip-flop 248 together with the Q output of flip-flop 250 are provided as inputs to AND gate 264 driving a differentiating circuit comprising capacitor 268 and resistor 270. The interconnection between components 268 and 270 is coupled to OR gates 274 and 258 for driving the reset terminals of flip-flops 244, 246, 252 and 254. Furthermore, the $\overline{Q}$ output of flip-flop 252 and the Q output of flip-flop 254 are inputs to AND gate 272 driving the differentiating circuit comprising capacitor 276 and resistor 278, wherein the junction between elements 276 and 278 is connected as an input to OR gates 266 and 258 for driving the reset terminals of flip-flops 244, 246, 248 and 250. As also previously noted, the Q output of flip-flop 254 is connected as an input to NOR gates 280 and 282. Therefore, neither a sharp nor a flat indication can be given if the Q output of flip-flop 254 is up indicating an on-frequency condition.

Returning to the sharp indicating circuitry, it will be noted the output of NOR gate 242 occurs after the end of the gating period. Thus, should an on-frequency condition be indicated by the output of gate 12, then one input of gate 240 will be up causing its output to be up and there will be no sharp indicating output from gate 242. This prevents a false sharp indication when, as a matter of fact, an on-frequency condition should be detected. The circuit prevents the sharp flip-flops from resetting the on-frequency flip-flops until the end of the gating period.

As hereinbefore discussed, when an out-of-lock condition is indicated by lock detector 307, then note counter 84, oscillator 22, divider 24, control counter 20, flip-flop 32 and display 310 are disabled. Referring particularly to FIGS. 2 and 3, it can be noted that output 208 from the lock detector goes up in an out-of-lock condition. NAND gate 30 is enabled thereby, and the output of gate gate 30 goes low when the out-of-lock condition occurs during the gating period, i.e., when the Q output of flip-flop 32 is up. Consequently, the normally high enabling input for AND gate 28 from NAND gate 30 will go low, causing counter 20 to discontinue counting. Also, the output of NAND gate 30 is reversed in polarity by NAND gate 106 for producing a positive going signal which resets counter 20 via OR gate 128, flip-flop 500 via OR gate 234, flip-flop 32 via OR gate 34, and divider counter 24. The high going output of NAND gate 106 is also coupled as an input to OR gate 122 whereby note counter(II) 84 will be reset.

When out-of-lock occurs, one-shot multivibrator 100 in FIG. 2 produces a high going output on lead 209 which acts to disable NOR gates 280 and 282 in FIG. 3, thereby disabling the sharp and flat elements of the display. A low going output from one-shot multivibrator 100 on lead 450 is applied to AND gate 284 such that the on-frequency display is also disabled. Thus, false readings are avoided until the oscillator 64 returns to a locked condition with reference to the input waveform.

According to the present invention there is thus provided a very accurate frequency detecting or tuning apparatus which gives a readily visible on-frequency indication within a fractional part of one cycle of the sound waveform. The circuitry is in the main digital and capable of compact arrangement, allowing portability. An instrument such as a guitar or the like is readily tuned, visually, employing this portable device without use of complex equipment and without the need for training in operating the same. The reading is stable and unambiguous, preventing inaccurate setting or adjusting to the wrong frequency, assuming the operator can identify the strings of the guitar by note and select the same on the display according to their visual representation.

The note and octave is selected by means of pushbuttons 320 and 322 which are depressed a number of times until the correct note and octave is visually indicated by displays 46 and 48. The transducer is placed on or near the instrument, while the corresponding note is strummed. A display 310 provides a stable and readily visible indication as to whether the string is sharp, flat or on-frequency and the display may be observed while a particular string is tuned. Tuning is readily accomplished with the minimum of time and expense.

While we have shown and described a preferred embodiment of our invention, it will be apparent to those skilled in the art that many changes and modifications may be made without departing from our invention in its broader aspects. We therefore intend the appended claims to cover all such changes and modifications as fall within the true spirit and scope of our invention.

What is claimed is:

1. Frequency detection apparatus for tuning a stringed instrument or the like, comprising:

a transducer for receiving sound information from a vibrating string on said instrument and for converting the same into an electrical signal of like frequency, selection means for selecting a note corresponding to a correct frequency to be detected, a filter for receiving said electrical signal and responsive to said selection means for filtering second harmonic information from said electrical signal, a first oscillator phase locked to the signal provided by said filter for generating a phase locked signal, a second oscillator also responsive to the signal provided by said filter to produce a standard frequency output signal initiated in synchronous time relation with the signal provided by said filter, a control counter coupled to the output of said second oscillator for counting the output cycles of said standard frequency output signal, and a gating circuit responsive to a count of said control counter for gating said phase locked signal during a gating period as determined by a predetermined counted number of cycles of said standard frequency output signal, note counter means coupled for receiving the phase locked signal as gated by said gating circuit for detecting whether the number of output cycles of the gated phase locked signal received during said gating period reaches a predetermined count corresponding to the note selected by said selection means, and display means for producing first, second and third indications for respectively indicating substantial identity in frequency between the electrical signal and the note selected by said selection means, or whether the electrical signal is above or below said note, said display means receiving the output of said note counter means substantially at the end of said gating period produced by said gating circuit to determine whether said note counter means has made a full count corresponding to the selected note substantially at the end of said gating period.

2. The apparatus according to claim 1 wherein said note counter means includes a note counter for counting said phase locked signal as gated by said gating circuit, and a plurality of note gates, each responsive to a note selection by said selection means for recognizing a particular count output from said note counter, said note gates supplying a common output, said display means being responsive to said gating circuit at the end of the gating period for testing said common output from said note gates to determine whether said note counter means has made said full count corresponding to the selected note substantially at the end of said gating period.

3. The apparatus according to claim 2 wherein said display means includes coincidence gate means for receiving the common output of said note gates and an indication of the end of said gating period from said gating circuit for determining substantial identity between the electrical signal and the note selected by said selection means.

4. The apparatus according to claim 3 including further gate means for receiving the common output of said note gates and an indication of the continuance of said gating period for determining a sharp signal.

5. The apparatus according to claim 4 including additional further gate means for detecting the absence of an output indication from either said coincidence gate means or said further gate means for determining a flat signal.

6. The apparatus according to claim 1, wherein said display means includes:

a first flip-flop means being responsive to an output of said note counter means at the end of the gating period produced by said gating circuit for indicating substantial identity between the note selected and said electrical signal, a second flip-flop means responsive to a high count by said note counter means during the period of gating by said gating circuit for indicating a sharp condition, a third flip-flop means operative when said note counter means does not produce a count corresponding to the selected note during the gating period of said gating circuit for indicating a flat condition, and first, second and third indication means for respectively representing the states of said flip-flop means.

7. The apparatus according to claim 6 wherein each of said flip-flop means comprises a first toggle flip-flop and second output flip-flop, wherein said toggle flip-flop is responsive to the output of said note counter means and triggers said second flip-flop when toggled by a second substantially identical input from said note counter means.

8. The apparatus according to claim 6 including resetting circuitry between said flip-flop means for resetting the other two flip-flop means upon the actuation of one flip-flop means.

9. The apparatus according to claim 1 further including a lock detector coupled to said first oscillator for detecting when said first oscillator is locked to the signal as received from said filter, and means for coupling the output of said lock detector for inhibiting said note counter means, said second oscillator, said control counter, said gating circuit and said display means when said first oscillator is not phase locked to the signal output of said filter.

10. The apparatus according to claim 1 wherein said phase locked signal generated by said second oscillator is a multiple of the signal provided by said filter.

11. The apparatus according to claim 1 wherein said selection means further includes octave selecting means, said filter also being responsive to said octave selecting means, and a dividing circuit between said first oscillator and said gating circuit and responsive to said octave selecting means for frequency dividing said phase locked signal for input to said note counter means as a higher octave note is selected.

12. The apparatus according to claim 1 wherein said display means includes averaging means for enabling an output upon repeated occurrence of comparison.

13. The apparatus according to claim 1 wherein said display means includes averaging means for enabling an indication upon repeated occurrence of a count.

14. Frequency detection apparatus for tuning a stringed instrument or the like, comprising:

transducer means for receiving sound information from a vibrating string on said instrument and for generating an electrical signal in response thereto, first means for supplying a first output responsive to said electrical signal starting in synchronism with said electrical signal, second means substantially independent of said first means for supplying a second output responsive to said electrical signal starting in synchronism with said electrical signal, said second means comprising an oscillator and means responsive to said electrical signal for starting oscillation of said oscillator in synchronism with said electrical signal, the first means being responsive to said electrical signal to provide a said first output indicative of the frequency of said electrical signal, and the second means providing a standard second output signal, and and comparison means for comparing said first output with a predetermined number of cycles of said second output signal to provide an indication whether the first output signal substantially matches a predetermined standard, and including means for indicating whether the first output is higher in frequency than said standard or is lower in frequency than said standard, wherein said comparison means for indicating the first output substantially matches the standard includes a first flip-flop means, wherein said means for indicating a higher frequency includes a second flip-flop means, and wherein said means for indicating a lower frequency includes a third flip-flop means.

15. The apparatus according to claim 14 wherein each of said flip-flop means comprises a first toggle flip-flop and a second output flip-flop, wherein said toggle flip-flop triggers the second flip-flop when toggled by a second substantially identical input.

16. Frequency detection apparatus for tuning a stringed instrument or the like, comprising:

transducer means for receiving sound information from a vibrating string on said instrument and for generating an electrical signal in response thereto, first means for supplying a first output responsive to said electrical signal starting in synchronism with said electrical signal, said first means comprising an oscillator, second means substantially independent of said first means for supplying a second output responsive to said electrical signal starting in synchronism with said electrical signal, said second means comprising an oscillator and means responsive to said electrical signal for starting oscillation of the last mentioned oscillator in synchronism with said electrical signal, the first means being responsive to said electrical signal to provide a first output indicative of the frequency of said electrical signal, and the second means providing a standard second output signal, and comparison means for comparing said first output with a predetermined number of cycles of said second output signal to provide an indication whether the first output substantially matches a predetermined standard.

17. The apparatus according to claim 16 further including a phase lock circuit for locking the output of the first mentioned oscillator to said electrical signal, and means for ascertaining when said output is not locked to said electrical signal for inhibiting an output indication of said apparatus.

18. The apparatus according to claim 16 wherein said transducer means generates said electrical signal as a signal which is a multiple of the frequency of said sound information.

* * * * *

UNITED STATES PATENT AND TRADEMARK OFFICE

CERTIFICATE OF CORRECTION

PATENT NO. : 4,227,437

DATED : October 14, 1980

INVENTOR(S) : THOMAS L. INLOES AND DARWIN E. GEORGE

It is certified that error appears in the above—identified patent and that said Letters Patent is hereby corrected as shown below:

Column 1, line 31, "sound" should be --second--.
Column 8, line 61, "the",second occurrence, should be deleted.
Column 9, line 17, "for",second occurrence, should be deleted.
Column 10, line 3, "or", second occurrence, should be deleted.
Column 11, line 36, "gate", second occurence, should be deleted
Column 14, line 35, claim 14, "and" should be deleted.

Signed and Sealed this

First Day of December 1981

[SEAL]

*Attest:*

GERALD J. MOSSINGHOFF

*Attesting Officer* *Commissioner of Patents and Trademarks*